US005287776A

United States Patent [19]

Williams et al.

[11] Patent Number: 5,287,776

[45] Date of Patent: Feb. 22, 1994

[54] INNER TIE ROD TOOL

[75] Inventors: Danny L. Williams, Clarinda, Iowa; Gerald A. McKim, LaFayette, Ind.

[73] Assignee: Lisle Corporation, Clarinda, Iowa

[21] Appl. No.: 904,852

[22] Filed: Jun. 26, 1992

[51] Int. Cl.[5] ..... B25B 13/06

[52] U.S. Cl. ..... 81/124.2; 81/124.4; 81/176.1; 81/177.2; 81/177.85; 81/180.1

[58] Field of Search ..... 81/124.6, 124.2, 124.4, 81/124.5, 176.1, 177.1, 177.2, 177.85, 180.1, 185.1, 185.2, 119, 121.1

[56] References Cited

U.S. PATENT DOCUMENTS

| | | | |
|---|---|---|---|
| 1,404,434 | 1/1922 | Derby | 81/121.1 |
| 2,987,080 | 6/1961 | Chandler et al. | 81/176.1 X |
| 5,035,162 | 7/1991 | Dougherty | 81/124.6 X |
| 5,101,695 | 4/1992 | Johnson | 81/124.6 |

FOREIGN PATENT DOCUMENTS

| | | | |
|---|---|---|---|
| 417339 | 11/1910 | France | 81/124.4 |
| 955548 | 1/1950 | France | 81/124.4 |

OTHER PUBLICATIONS

AD Part No. 8703, "Dual Inner Tie Rod Tool", Feb. 1992.

AD Part No. 8704, "Inner Tie Rod Wrench Adapter", Feb. 1992.

American Tool Co., Part No. 2100, "Tie Rodd Removal Tool", 1990.

American Tool Co., Part No. 2300, "3-1 Inner Tie Rod Removal Tool-Ford-GM-Chrysler", 1990.

Lisle Corporation, Part No. 61000, "1 3/16 inch Inner Tie Rod Wrench", Jan. 1990.

Lisle Corporation, Part No. 61100, "1 5/16 inch Inner Tie Rod Wrench", Jan. 1990.

*Primary Examiner*—D. S. Meislin

*Attorney, Agent, or Firm*—Allegretti & Witcoff

[57] ABSTRACT

An inner tie rod tool includes a hollow tube which fits over the rod and includes a socket at one end for cooperation with a socket tool. The opposite end includes a retainer which is cooperative with C-shaped wrench discs of various size and configuration that cooperate with the nut associated with the inner end of the inner tie rod.

6 Claims, 4 Drawing Sheets

INNER TIE ROD TOOL

BACKGROUND OF THE INVENTION

This invention relates to an improved inner tie rod tool and, more particularly, to an inner tie rod tool which is useful in the removal and replacement of various types of automobile inner tie rods.

American and foreign automobiles are often equipped with a rack and pinion steering control system. Such a rack and pinion system indudes a rack which is connected by means of tie rods to the front wheels of the vehicle. Rotation of the steering wheel rotates the pinion to drive the rack and simultaneously move the tie rods to effect steering by the front wheels.

Servicing and repair of such a rack and pinion steering control system often requires removal and replacement of the tie rods (including the inner tie rods) which connect the rack to the front wheels. The inner tie rods of a rack and pinion system may typically be comprised of a rod with a hexagonal nut located at the inner end and with threads at the outer end. The hexagonal nut is provided for cooperation with a wrench so that the rod can be rotated for attachment to rack assembly. The outer threaded end cooperates with a linkage attached to the front wheel of the automobile.

Alternatively, the inner tie rods may have a different construction. For example, the hexagonal nut at the inner end may be eliminated or altered in construction. This has resulted in increased difficulty in servicing the steering system, in many instances, resulting in the need to remove the entire rack and pinion system in order to effect appropriate repair and replacement of inner tie rods. The present invention is directed to a mechanism which permits the removal of inner tie rods without requiring the disassembly of the entire rack and pinion steering control assembly, and which is useful with multiple types of inner tie rods.

SUMMARY OF THE INVENTION

Briefly, the present invention comprises a hollow tube which fits over the inner tie rod. The tube has a socket at one end for cooperation with a driving wrench. At the opposite end, a special retainer collar is affixed to the tube. A nut engaging, C-shaped wrench fits over multiple nut configurations of the inner tie rod is cooperative with the retainer collar. The C-shaped wrench and the hollow tube are thus separable. The C-shaped wrench may thus be placed on the nut configuration of the tie rod, and the hollow tube may then be coupled to the wrench for rotation and removal or replacement of the tie rod.

Thus, it is an object of the invention to provide an inner tie rod tool which is useful for servicing all types of inner tie rod constructions, including those which do not necessarily have a hexagonal nut at the inner end thereof.

It is a further object of the invention to provide an improved, mechanically rugged, inexpensive, and easy to operate inner tie rod tool.

It is yet another object of the invention to provide an inner tie rod tool comprised of two separable parts including a removable wrench which cooperates with the nut on the inner end of an inner tie rod and a tube which cooperates with the wrench.

These and other objects, advantages, and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENT

Figure 1:
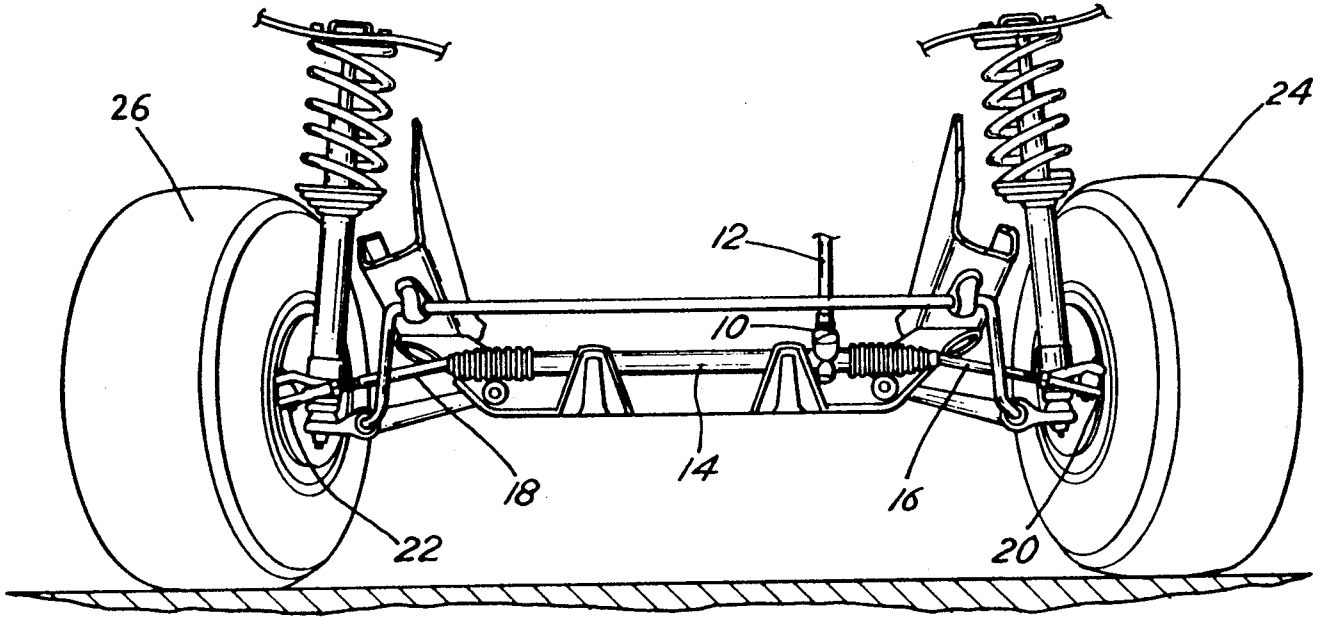
FIG. 1 is an elevation of a typical rack and pinion steering control system depicting the environment of the invention.

FIG. 1 illustrates a typical rack and pinion steering control system associated with the front wheels of a vehicle. A pinion steering gear 10 is driven by operation of a shaft or rod 12 associated with the vehicle steering wheel (not shown). A rack 14 moves in response to rotation of shaft 12 to move inner tie rods 16 and 18 which cooperatively engage outer yokes 20 and 22 respectively. Movement of yokes 20, 22 effects movement or steering of the wheels 24 and 26.

Figure 6:
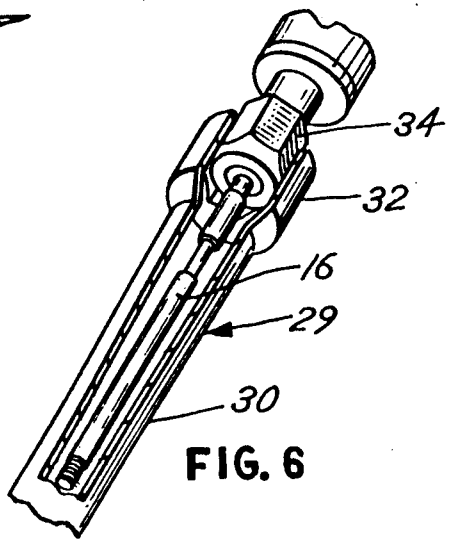
FIG. 6 is a depiction of the method of operation of the prior art inner tie rod removal tool of FIG. 5.
Figure 5:
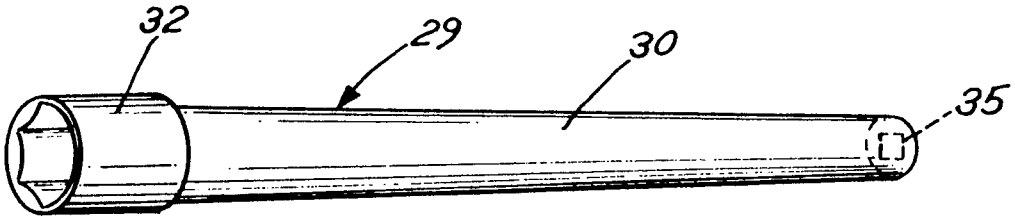
FIG. 5 is a depiction of a prior art inner tie rod removal tool.

When servicing the rack and pinion steering system depicted in FIG. 1, it is often necessary to remove the tie rods 16, and 18. Heretofore, in order to effect such removal, it was often necessary to remove the entire rack and pinion steering control assembly, including the rack 14. However, various tools have developed for removal of the inner tie rods 16, 18 without total disassemly of the assembly. A typical prior art tool 29 is shown in FIGS. 5 and 6. Tool 29 is comprised a hollow tube 30 having a socket 32 at one end which is cooperative with a hexagonal nut 34 in FIG. 2 of inner tie rod 16. The tube 30 thus fits over the tie rod 16 so that socket 32 maybe engaged with nut 34. The opposite end of tool 29 includes a wrench socket 35 for receipt of a driver which can rotate the tool 29 and inner tie rod 16. In this manner, as shown in FIG. 6, the inner tie rod 16 may be removed and replaced.

Figure 4:
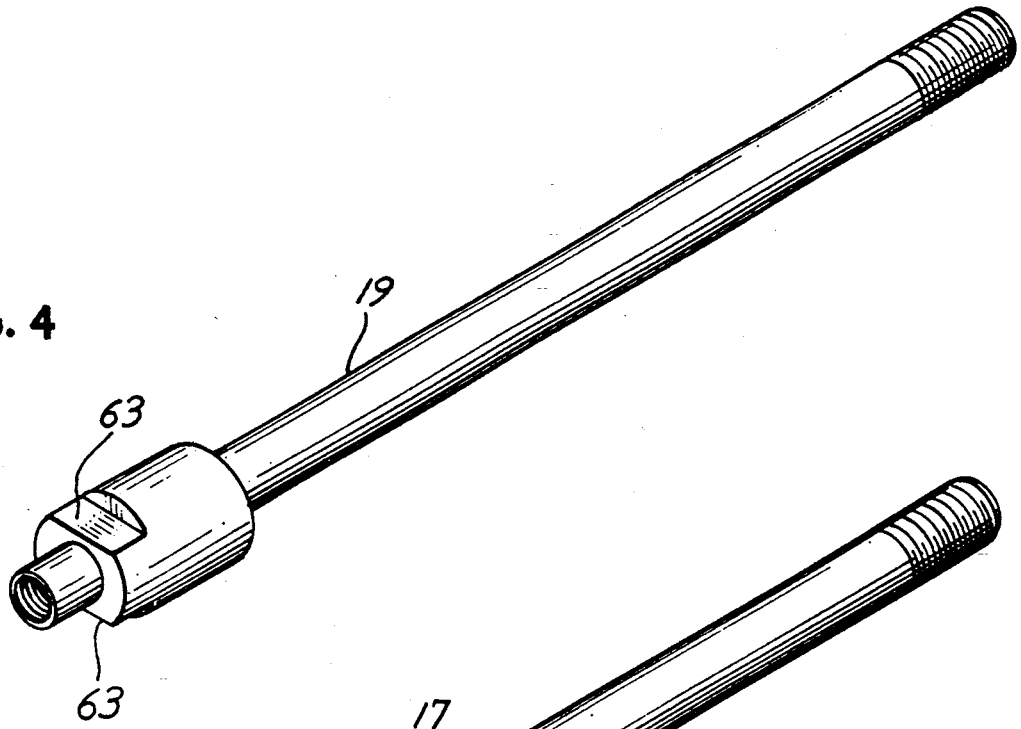
FIG. 4 is a perspective view of a third embodiment of an inner tie rod.
Figure 3:
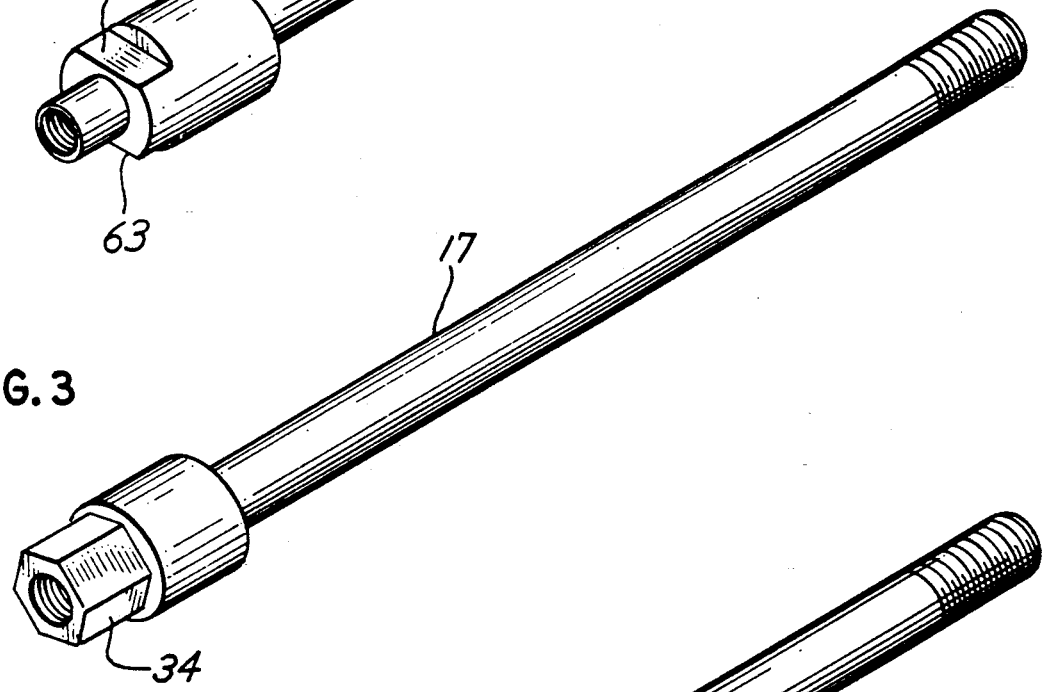
FIG. 3 is a prospective view of another configuration of an inner tie rod.
Figure 2:
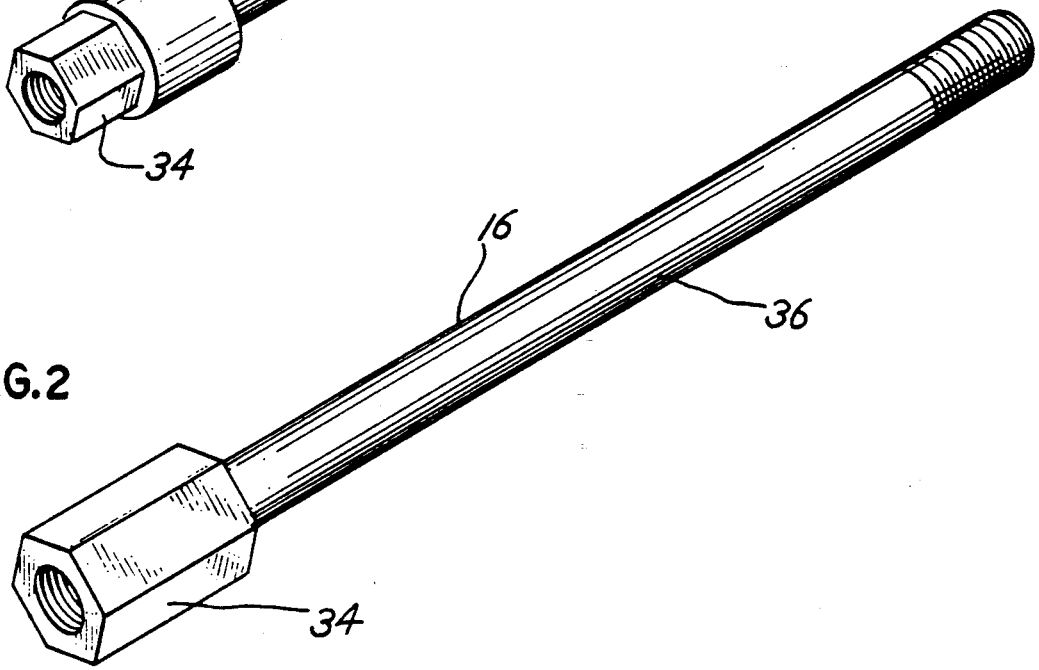
FIG. 2 is a perspective view of a typical inner tie rod.
Figure 7:
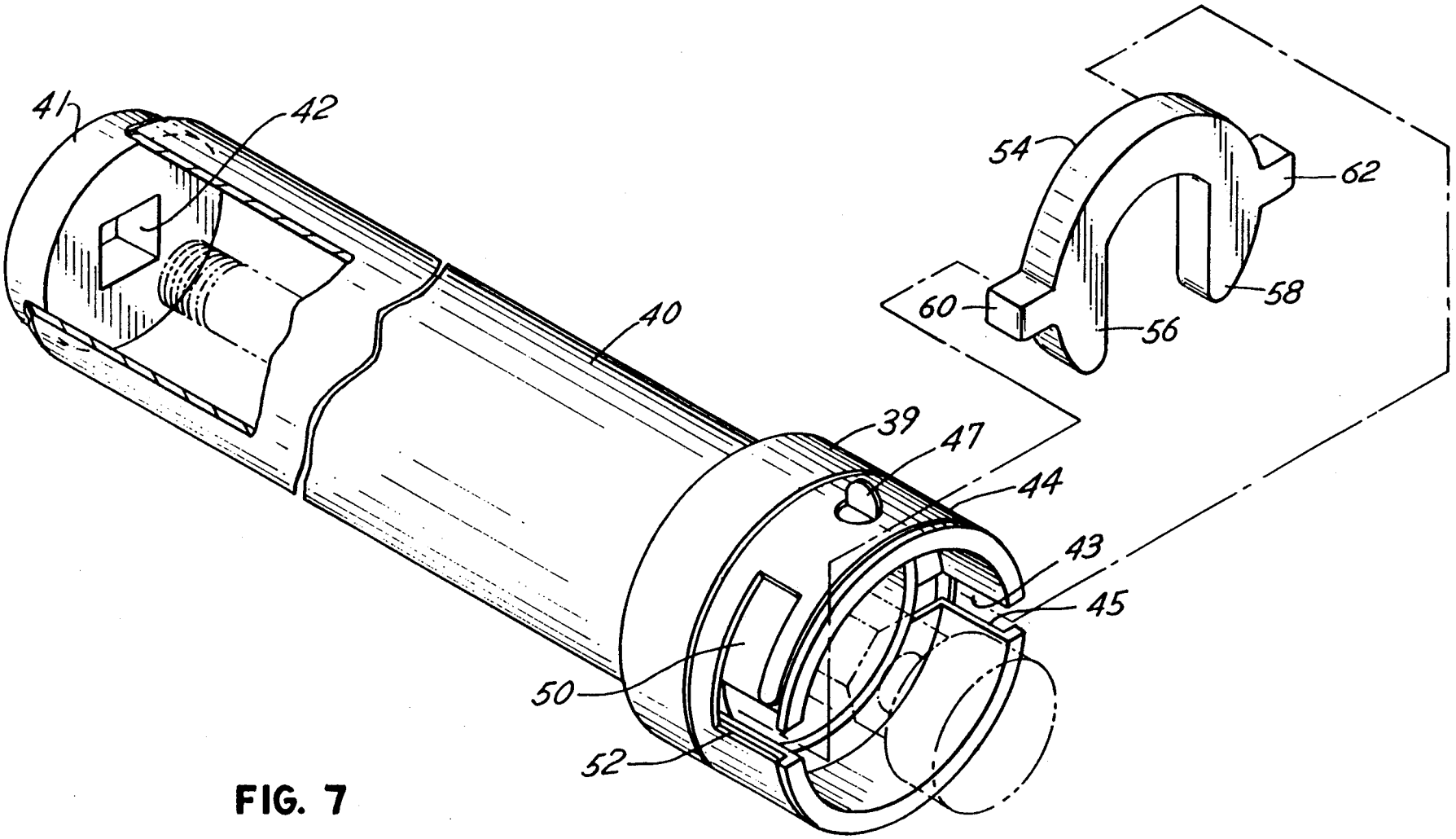
FIG. 7 is a perspective view of the improved inner tie rod tool of the present invention as it is utilized to remove an inner tie rod of the type shown in FIG. 3.
Figure 10:
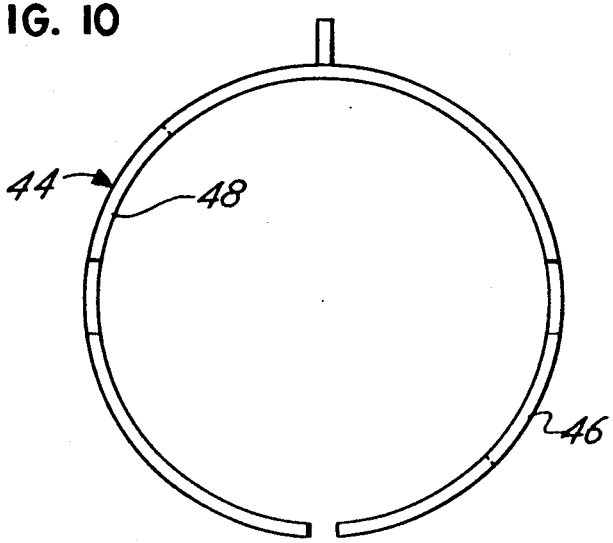
FIG. 10 is a side elevation of the sleeve of FIG. 9.
Figure 9:
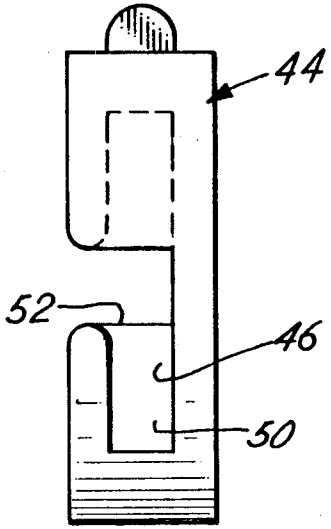
FIG. 9 is an elevation of the retaining sleeve of the improved tie rod tool of the invention.
Figure 8:
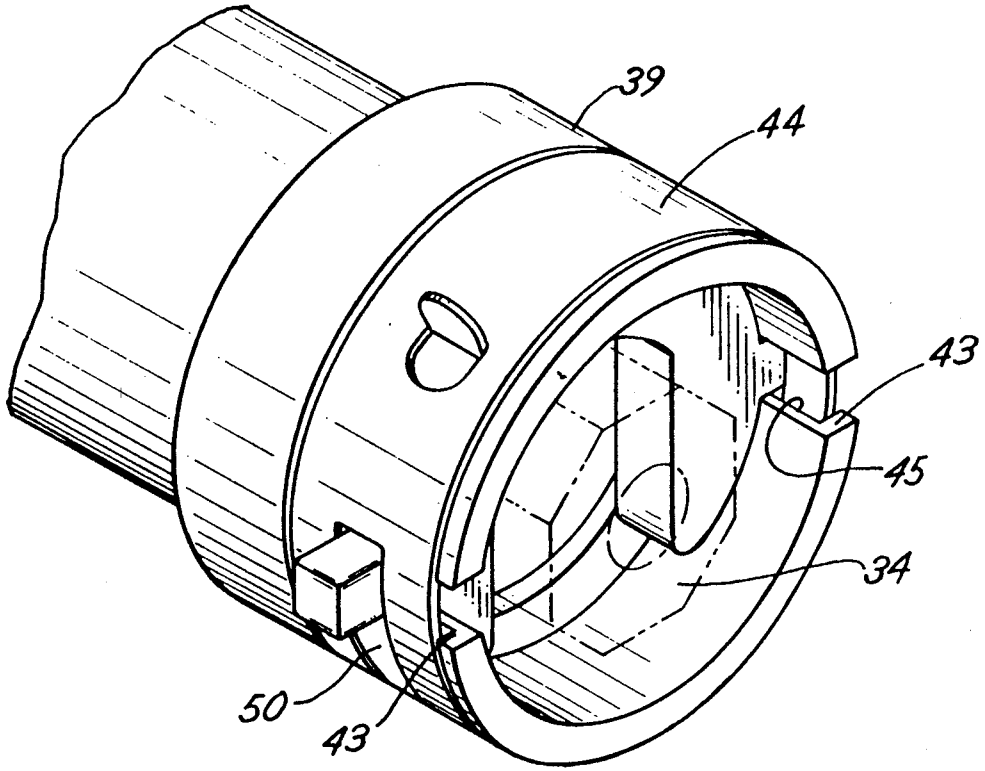
FIG. 8 is an enlarged perspective view of the nut engaging and of the improved inner tie rod tool of the invention as utilized to remove an inner tie rod.

FIGS. 3 and 4 illustrate two configurations of inner tie rods 17, 19 which became available in the marketplace subsequent to the inner tie rod 16 of FIG. 2. The present invention relates to a tool which is useful with all types of inner tie rods 16, 17, 19 such as shown in FIGS. 2, 3 and 4.

Specifically referring to FIGS. 7 through 10, the improved inner tie rod tool includes a hollow tube 40 having a fitting 41 with a socket 42 at one end for cooperation with a ratchet wrench. The opposite end of hollow tube 40 includes a large diameter cylindrical section 39, with a retainer ring 44 affixed over the section 39. The cylindrical section 39 includes two slits 43 which extend axially from the end of Section 41 along the axis of hollow tube 40. Retainer ring 44 is rotatably mounted on the outside surface of circulor ring or section 39 and is retained in a groove 45. The retainer ring 44 includes two L-shaped slots 46 and 48 and an outwardly projecting tab 47. Each L-shaped slot 46 and 48 and an outwardly projectly tab 47. Each L-shaped slot 46 and 48 includes a circumferential run 50 and a axial run 52. Axial run 52 is generally aligned with slits 43. (See FIG. 7).

A separate part of the tool comprises a generally C-shaped flat disc 54 having spaced arms 56 and 58. Radically outwardly projecting tabs 60 and 62 are defined on the outer periphery of the disc 54. The arms 56 and 58 define opposite sides of a wrench that is cooperative with a nut 34 or flats 63 as depicted in FIGS. 2, 3, 4, 7 and 8. Differently sized discs 54 may be utilized for different sized nuts 34 or flats 63.

The radial tabs 60 and 62 cooperatively engage and cooperate with the slits 43 and slots 46 and 48. Thus, the tabs 60 and 62 are separated from each other so they may be inserted into the spaced slits 43 and locked into position by appropriate rotation of the retainer ring or sleeve 44. The entire tool may then be rotated to thus rotate an inner tie rod 16, 17, 19. Note two slits 43 spaced about 180° are preferred. However, additionally slits and alternative spacings are possible for cooperation with compatible wrench construction.

With the tool of the present invention therefore it is possible to utilize the single tube 40 in cooperation with any one of a number of wrench discs 54 depending upon the configuration and size of the inner end of the inner tie rod. The inner tie rod tool of the invention is thus more universal in its operation than prior art constructions.

Note, the wrench discs 54 have a limited axial dimension or thickness. This enables placement of a disc 54 on the flats 63 or over almost any configuration of nut 34 prior to attachment of tube 40 to disc 54 via section 39 and ring 44. Also, ring 44 includes a tab 47 which projects outward to facilitate rotation of ring 44 in the gloove 45. Consequently, in operation, the wrench disc 54 is initially placed on the nut of the inner tie rod. Next, the tube 40 is placed over the tie rod, engaged with wrench disc 54, attached thereto by ring 44 and driven via socket 42. The sequence is revised to remove the tool from the inner tie rod.

It is possible to vary the configuration and shape of the disc 54, for example, as well as the retainer 44. The number of slots and the number of tabs, for example, may be altered. Thus, while there has been set forth a preferred embodiment of the invention, it is to be understood that the invention is to be limited only by the following claims and their equivalents.

We claim:

1. A tool for removal of inner tie rods comprising in combination:

(a) a nut engaging, C-shaped wrench disc having spaced arms for engaging a nut, and outwardly projecting tabs for cooperation with a retainer; and (b) a hollow tube for placement over a tie rod, said tube having a retainer at one end and at least two slots for cooperatively engaging the tabs of the wrench disc and means for cooperation with tube rotation means at the opposite end, said retainer being detachably cooperative with the tabs to rotate the disc and a tie rod engaged therewith.

2. The tool of claim 1 wherein the means for cooperation with tube rotation means comprise a socket.

3. The tool of claim 1 wherein the disc includes first and second tabs radially projecting outwardly in opposite directions from the center of the disc.

4. The tool of claim 1 wherein the retainer includes slots therein for receipt of the tabs.

5. The tool of claim 1 including a plurality of discs each cooperative with the retainer, each disc being separately cooperative with a different size nut.

6. The tool of claim 1 wherein the retainer includes a rotatably sleeve, the slots of the retainer being disposed on said rotatable sleeve and being L-shaped for rotation of the sleeve for locking receipt of a tab.

* * * * *